US007246474B2

(12) United States Patent
Dombek et al.

(10) Patent No.: US 7,246,474 B2
(45) Date of Patent: Jul. 24, 2007

(54) METAL SHINGLE SYSTEM

(75) Inventors: Gerald M. Dombek, St. Louis, MO (US); Roger L. Kramer, St. Louis, MO (US); Jeffrey L. Widenor, Chesterfield, MO (US); Nicholas L. Allen, St. Louis, MO (US); Joseph R. Nicholson, Monkton (CA)

(73) Assignee: Sequa Corporation

( * ) Notice: Subject to any disclaimer, the term of this patent is extended or adjusted under 35 U.S.C. 154(b) by 338 days.

(21) Appl. No.: 10/947,184

(22) Filed: Sep. 22, 2004

(65) Prior Publication Data

US 2006/0059831 A1 Mar. 23, 2006

(51) Int. Cl.
*E04D 1/00* (2006.01)

(52) U.S. Cl. ..... 52/533; 52/519; 52/523; 52/529; 52/541; 52/545; 52/547

(58) Field of Classification Search ..... 52/519, 52/523, 524, 525, 526, 527, 533, 535, 546, 52/539, 545, 547
See application file for complete search history.

(56) References Cited

U.S. PATENT DOCUMENTS

| | | | | |
|---|---|---|---|---|
| 307,590 | A | 11/1884 | Regan | |
| 373,373 | A | 11/1887 | Montross | |
| 503,173 | A | 8/1893 | Spahmer, Jr. | |
| 943,888 | A | 12/1909 | Pedlar | |
| 1,410,299 | A | 3/1922 | Harshberger | |
| 1,539,632 | A | 5/1925 | Belding | |
| 1,575,974 | A | 3/1926 | Conway | |
| 1,583,969 | A | 5/1926 | Greenstreet | |
| 1,597,993 | A | 8/1926 | Meurer | |
| 1,670,041 | A | 5/1928 | Miller | |
| 1,743,206 | A | 1/1930 | Fulenwider et al. | |
| 1,876,597 | A | 9/1932 | Bennett | |
| 2,042,890 | A | 6/1936 | Fulenwider et al. | |
| 2,380,398 | A | 7/1945 | Booth | |
| 2,685,852 | A | 8/1954 | Godel | |
| 2,822,762 | A | 2/1958 | Berg | |
| 3,209,506 | A | 10/1965 | Waske | |
| 3,347,001 | A | 10/1967 | Cosden | |
| 3,380,214 | A * | 4/1968 | Stevens | 52/478 |

(Continued)

OTHER PUBLICATIONS

US 5,832,686, 11/1998, Plath et al. (withdrawn)

*Primary Examiner*—Cari D. Friedman
*Assistant Examiner*—Chi Q. Nguyen
(74) *Attorney, Agent, or Firm*—Mitchell D. Bittman; Robert C. Frame; Kevin S. Lemack

(57) ABSTRACT

A metal shingle system which is resistant to leakage, even under severe weather conditions. The key attribute of the new system to the design of the side edge of the shingle such that water that seeps between adjacent shingles cannot be blown upward. Briefly, the top edge is overturned and the bottom edge is underturned such that they can be interconnected as is well known in the art. One side edge is folded to form a gutter area into which water that seeps between laterally adjacent shingles is collected and drained onto the lower row of shingles. The top of the gutter area is blocked by the overturned top edge, which extends into the gutter region. Also disclosed is an improved tool for cutting the shingles, such as is needed around obstructions and at the end of the roofline.

4 Claims, 9 Drawing Sheets

Top View - Single Shingle A

U.S. PATENT DOCUMENTS

| | | | | | |
|---|---|---|---|---|---|
| 3,411,259 | A | * | 11/1968 | Anderson et al. | 52/531 |
| 3,667,184 | A | | 6/1972 | Merrill et al. | |
| 4,593,512 | A | | 6/1986 | Funaki | |
| 4,601,135 | A | | 7/1986 | Ellis et al. | |
| 4,715,157 | A | * | 12/1987 | Funaki | 52/529 |
| 4,780,995 | A | | 11/1988 | Gittins | |
| 4,912,900 | A | | 4/1990 | Yeamans | |
| 4,992,315 | A | * | 2/1991 | Zickell et al. | 428/40.3 |
| 5,349,801 | A | * | 9/1994 | Verbofsky | 52/518 |
| 5,469,680 | A | | 11/1995 | Hunt | |
| 5,605,020 | A | | 2/1997 | Chambers | |
| 5,613,337 | A | | 3/1997 | Plath et al. | |
| 5,657,603 | A | * | 8/1997 | Goodhart et al. | 52/16 |
| 5,685,117 | A | | 11/1997 | Nicholson | |
| 5,784,848 | A | * | 7/1998 | Toscano | 52/519 |
| 5,953,810 | A | * | 9/1999 | Goodhart et al. | 29/557 |
| D415,848 | S | | 10/1999 | Plath et al. | |
| D423,122 | S | | 4/2000 | Plath et al. | |
| 6,173,546 | B1 | * | 1/2001 | Schafer | 52/522 |
| 6,272,797 | B1 | | 8/2001 | Finger | |
| RE38,210 | E | * | 8/2003 | Plath et al. | 52/533 |
| 6,883,290 | B2 | * | 4/2005 | Dinwoodie | 52/748.1 |

* cited by examiner

Top View - Single Shingle A

Top View - Single Shingle B

PLIERS - FRONT VIEW

METAL SHINGLE SYSTEM

BACKGROUND OF THE INVENTION

There have been various designs for metal roofing shingles. These metal shingles typically attempt to replicate the aesthetic properties of traditional slate and cedar shingles while maintaining a degree of weather resistance expected with steep slope roofing products. Numerous patents have been granted on variations of these shingles, all of which attempt to create a substantially weather resistant metal shingle. Examples of these shingles can be found in U.S. Pat. No. 503,173 (Spahmer), U.S. Pat. No. 1,597,993 (Meurer), U.S. Pat. No. 1,743,206 (Fulenwider et al), U.S. Pat. No. 1,876,597 (Bennett), U.S. Pat. No. 5,469,680 (Hunt), and U.S. Pat. No. 5,832,686 (Plath et al).

The Spahmer patent discloses a single course shingle system where the opposing sides of each shingle are bent to create interlocking folds. Similarly, the top and bottom edge of each shingle are optionally bent to create interlocking folds. These shingles can then be assembled together by inserting the left edge of the shingle into the right edge of a previously installed shingle, while inserting the bottom edge into the top edge of a second previously installed shingle. The Spahmer patent discloses cutting the metal away in each of the corners to facilitate the process of creating folds along each edge. As a result, the corners of the shingles are susceptible to leakage in the event of severe weather conditions.

The Meurer patent discloses a single course shingle system where the left side of each shingle contains a tongue and the right side of each shingle contains a corresponding groove. Also present on the right side is a nailing strip designed so as to facilitate the installation process. In this patent, upper rows of shingles overlap the adjacent lower row, however, there is no interlocking mechanism between these two rows. As a result, the shingle is susceptible to leakage during severe weather conditions when water may be blown upwardly between the rows.

The Fulenwider patent discloses a single course shingle system where each shingle has opposing side edges that define corresponding shoulders, an underturned bottom edge and an overturned top edge. The overturned top edge is secured to a separately formed lock fastener. The slightly upturned lip of the lock fastener engages with the underturned bottom edge of the shingle directly above it. However, the lock fastener does not create an adequate seal and therefore the shingle is susceptible to leakage during severe weather conditions.

The Bennett patent discloses a single course shingle system where each shingle has opposing overturned and underturned side edges and an underturned bottom edge. A dam strip is used to secure the top edge of the shingle to the roof. Nail holes are provided in the flat surface of the shingle, where they are overlapped by the adjacent upper row of shingles. This system is susceptible to leakage through the nail holes and along the dam strip during server weather conditions, when water may be blown upwardly between the rows.

The Hunt patent discloses a single course shingle system where each shingle has an overturned top edge and a corresponding underturned bottom edge, which is used to interlock adjacent rows of shingles. A joint pan is placed under adjacent shingles. This joint pan guides any water that leaks through onto the lower row of shingles. However, this system is still susceptible to leakage when water is blown upwardly on the joint pan.

The Plath patent discloses a single course shingle system in which a gutter is formed in the trailing edge by creating an "s" shaped fold. The opposing edge is not folded and is inserted into the "s" shaped fold as the shingles are installed. The top edge is overturned, and the bottom edge has a corresponding underturn. The underturn at the bottom edge of each row of shingles interconnects with the overturn at the top edge of the lower row of shingles. The gutter helps guide water from between adjacent shingles down onto the outer surface of the lower row. However, the upper edge of the gutter is not folded, so leakage can occur if water is blown upwardly through the gutter during severe weather conditions.

Because of the inherent stiffness and formability of metal, creating a water-resistant metal shingle system that does not leak is a difficult undertaking. The installation of such a roofing system is also difficult. Each of the aforementioned patents attempts to solve some aspect of these shortcomings.

SUMMARY OF THE INVENTION

The problems of the prior art have been overcome by the present invention, which provides a metal shingle system which is resistant to leakage, even under severe weather conditions. The key attribute of the new system occurs at the intersection point between the top edge and the side edge of the shingle. This design innovation ensures that moisture (or water) cannot flow upward and seep under the shingle course above. Briefly, the top edge is overturned and the bottom edge is underturned such that each row of shingles can be horizontally interconnected. In addition, one side edge is folded to form a gutter area into which water that seeps between laterally adjacent shingles is collected and drained onto the lower row of shingles. By overturning the top edge, as well as the top of the gutter area, this moisture block is extended into the gutter region and ensures that moisture is collected and drained onto the lower row of shingles. Also disclosed is a useful tool for forming the cut edge of the shingles, such as is needed at the end of the roofline and around roof penetrations.

DETAILED DESCRIPTION OF THE INVENTION

Figure 1:
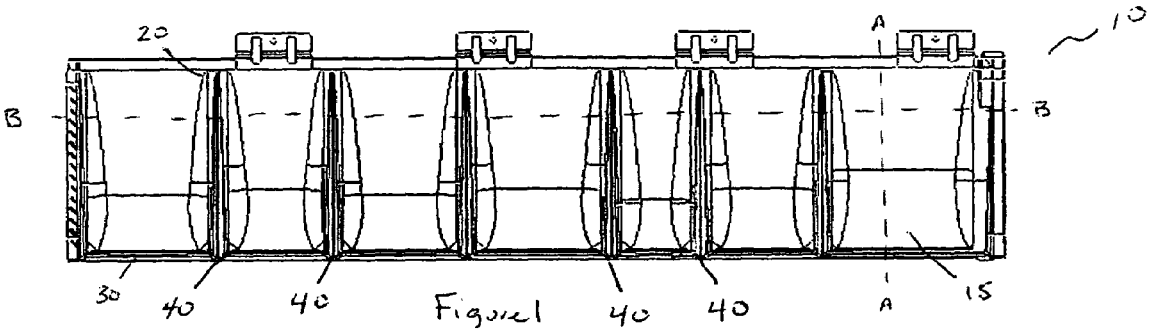
FIG. 1 is a top view of a shingle in accordance with a first embodiment of the present invention.

FIG. 1 shows a top view of a first embodiment of the metal shingle of the present invention. Metal shingle 10 is designed such that preferably about 8.625 inches of each metal shingle, as measured from top to bottom is exposed, and is preferably about 40.75 inches wide, although other sizes and ratios are acceptable. The preferred height and width of the exposed area are selected to simulate the appearance of traditional shingles. It provides installers with a metal shingle that is dimensionally similar to that which they use today. The width of the shingle can vary, if desired. Greater widths allow faster installation, since there are fewer shingles to install. Greater widths also allow higher metal utilization. However, greater shingle widths can be awkward to work with, especially in cases where there are gables and other irregularities in the roofing surface.

Shingle 10 has a top surface 15, which may be unfinished as in the case of copper, or preferably painted or otherwise decorated so as to resemble a cedar shingle. In the preferred embodiment, the top surface has a plurality of indentations 40 oriented longitudinally from the top edge 20 to the bottom edge 30 so as to give the appearance of multiple individual shingles, each roughly 4 to 8 inches in width, although these dimension can vary.

Figure 2:
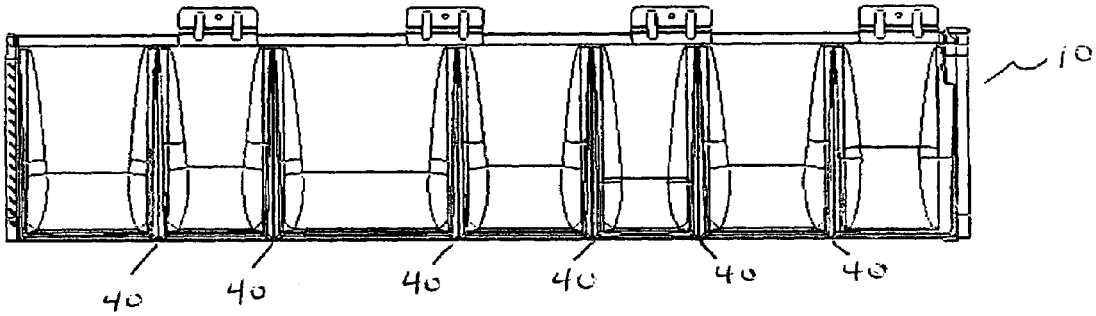
FIG. 2 is a top view of a shingle in accordance with a second embodiment of the present invention.

FIG. 2 shows a second embodiment of metal shingle 10. In this embodiment, the dimensions are the same as those in FIG. 1. However, the longitudinal indentations are spaced at different intervals than those of the first embodiment. In the preferred implementation, roofing installations would employ a combination of these embodiments so as to provide a random appearance when installed. While two specific embodiments are shown here, many others are possible, and the invention is not limited to solely these two embodiments. Additionally, more than two different embodiments can be employed to provide a more random appearance, if desired.

Figure 3:
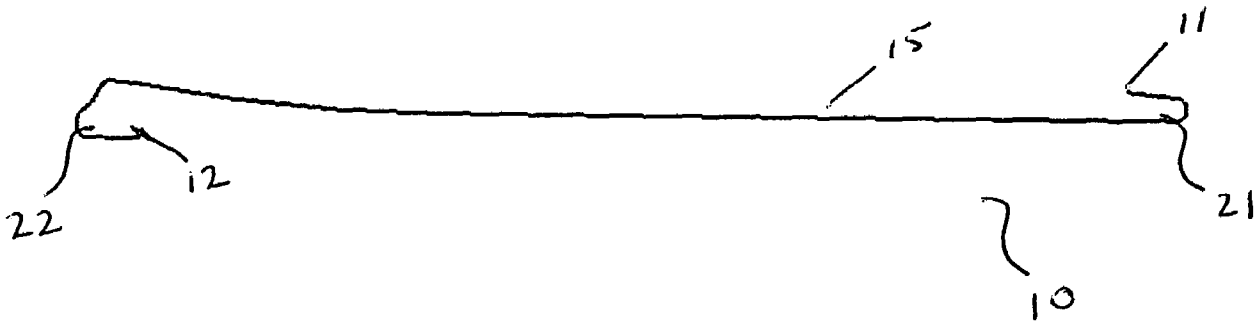
FIG. 3 is a cross sectional view of the shingle in FIG. 1 taken along line A-A.
Figure 6:
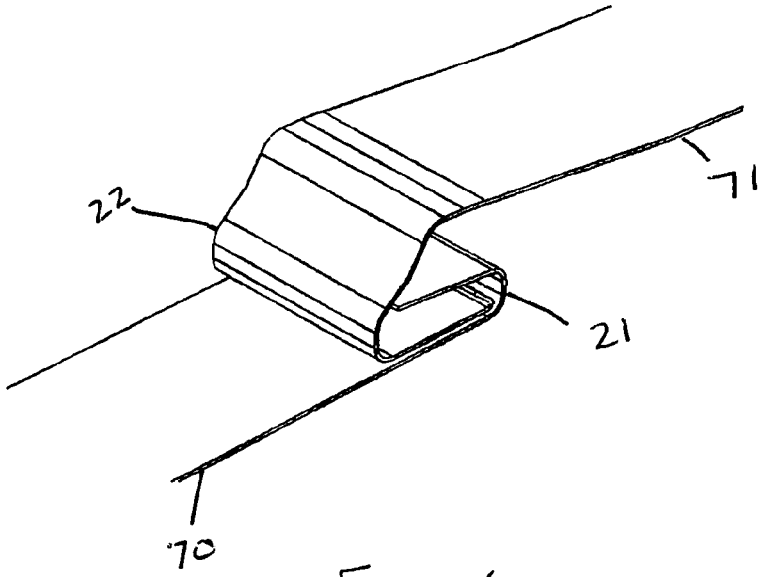
FIG. 6 is a perspective cross sectional view showing the interconnection of two shingles in adjacent rows.

FIG. 3 shows a cross-sectional view of metal shingle 10. Top edge 11 is folded over top surface 15 so as to form a first C shape 21. Bottom edge 12 is folded under top surface 15 so as to form a second C shape 22. During installation, the C shape 22 created by the bottom edge 12 of one shingle is engaged with the C shape 21 created by the top edge 11 of the shingle on the next lower row, which was previously installed. This interconnection method is well known to those skilled in the art. FIG. 6 illustrates this interconnection, with the C shape 21 of the lower shingle 70 interlocking with the C shape 22 of the upper shingle 71.

Figure 5:
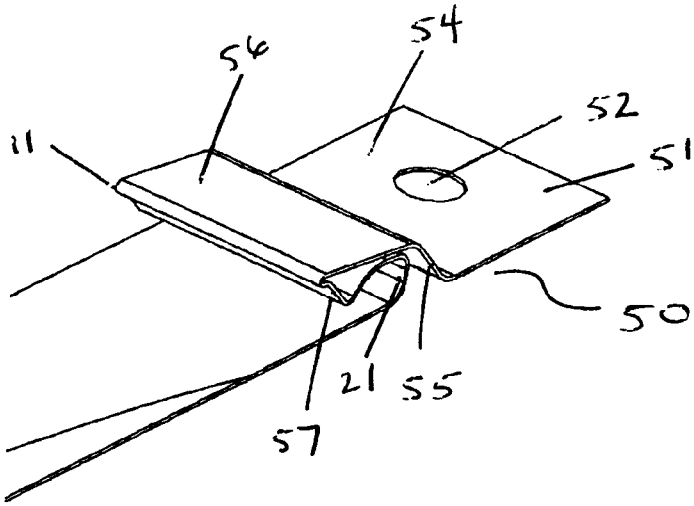
FIG. 5 is a perspective cross sectional view of a mounting tab of the shingle in FIG. 1.

As is best seen in FIG. 5, mounting tabs 50 protrude from top edge 11. Mounting tab 50 has a top edge 51, near which a hole 52 is located. The top surface 54 of the mounting tab 50 has an inclined portion 55 below the hole 52 so as to be raised above the roofing surface. A second level portion 56 is formed below the inclined portion 55. The tab is then folded under the second level surface 56 so as to form a protrusion 57 at roughly a 45 degree angle to level surface 56. The metal is then folded onto itself, along the underside of protrusion 57. At this point, the metal is bent to form C shape 21 of metal shingle 10, as exists along the remainder of the top edge of the metal shingle as shown in FIG. 2. The assembly is secured to the roofing surface by nailing through hole 52. In the preferred embodiment, mounting bracket 50 is an integral part of metal shingle 10. However, other embodiments are envisioned. In an attempt to optimize the use of sheet metal, the mounting tabs can be produced as separate pieces and secured to the metal shingles in a number of ways, such as, but not limited to, welding, pressure fitting, and gluing. Those skilled in the art will appreciate that although the mounting tabs 50 are preferred for securing each shingle to the roof, they are shown for illustrative purposes only and other means of securing the shingles to the roofing could be used without departing from the spirit and scope of the invention.

Figure 7:
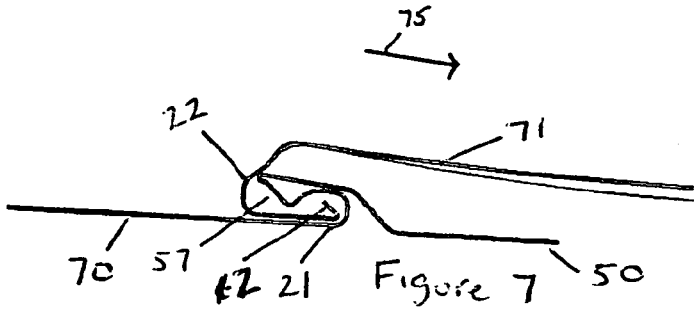
FIG. 7 is a side view showing the interconnection of two shingles at the mounting tab.

In the preferred embodiment, the metal shingle of the upper row "clicks" into place when interconnected with the metal shingle of the previous row. FIG. 7 illustrates the relative placement of the two shingles when they are locked in place. Lower shingle 70 is attached to the roofing surface using mounting tab 50. The C shape 22 of upper shingle 71 is appropriately positioned on lower shingle 70 and then moved toward C shape 21 of lower shingle 70 (i.e., upper shingle 71 is moved in the direction of arrow 75 in FIG. 7). As it moves into position, top edge 12 contacts protrusion 57 of the lower shingle. Further movement of the upper shingle 70 causes the protrusion to contract, and once top edge 12 has moved past protrusion 57, the protrusion will return to its natural position. Typically, as the protrusion returns to its natural position, a "click" will be heard and/or felt, thus alerting the installer that the shingles are properly interconnected.

Figure 4:
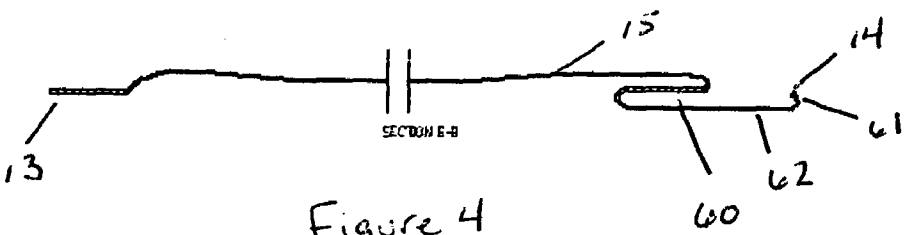
FIG. 4 is a cross sectional view of the shingle in FIG. 1 taken along line B-B.
Figure 8:
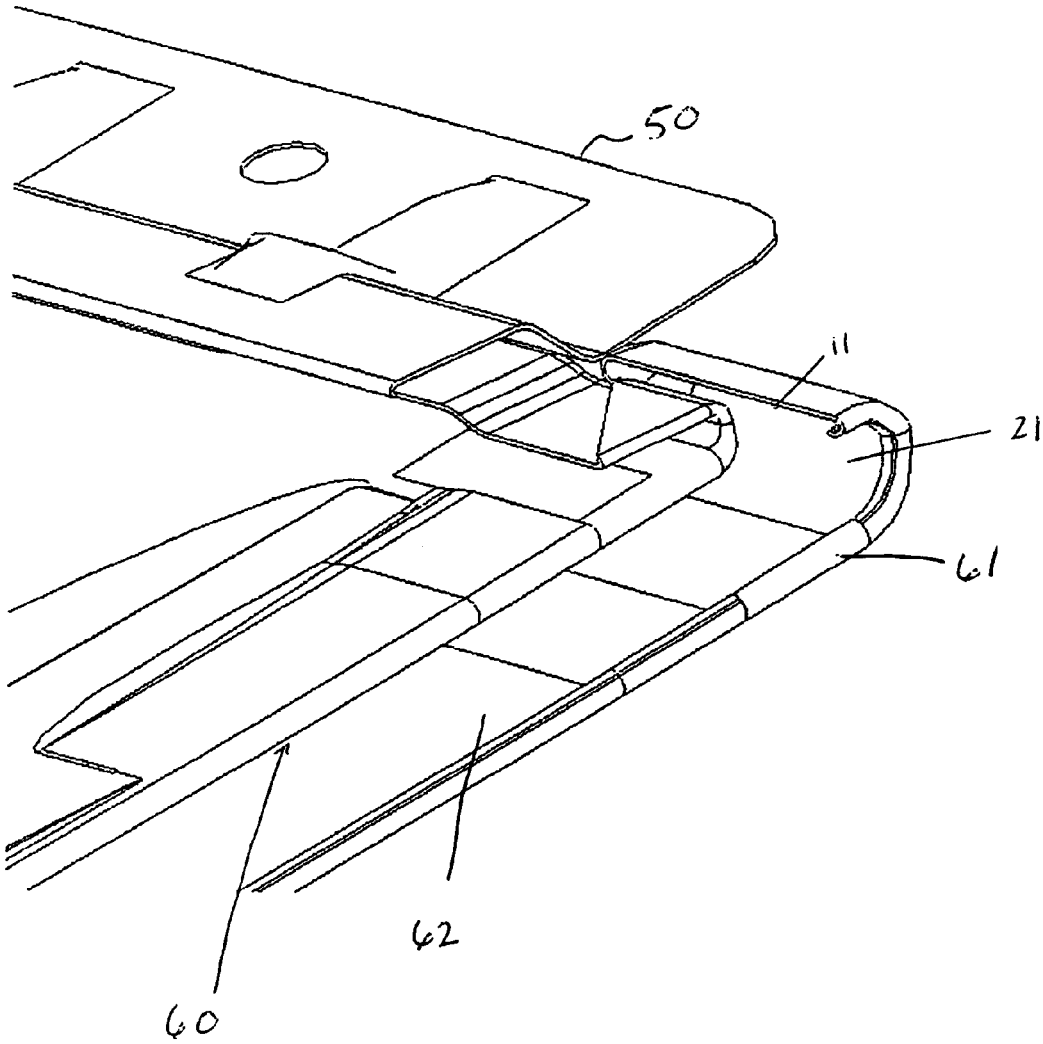
FIG. 8 is an exploded view of the upper right edge of the shingle in FIG. 1.
Figure 9:
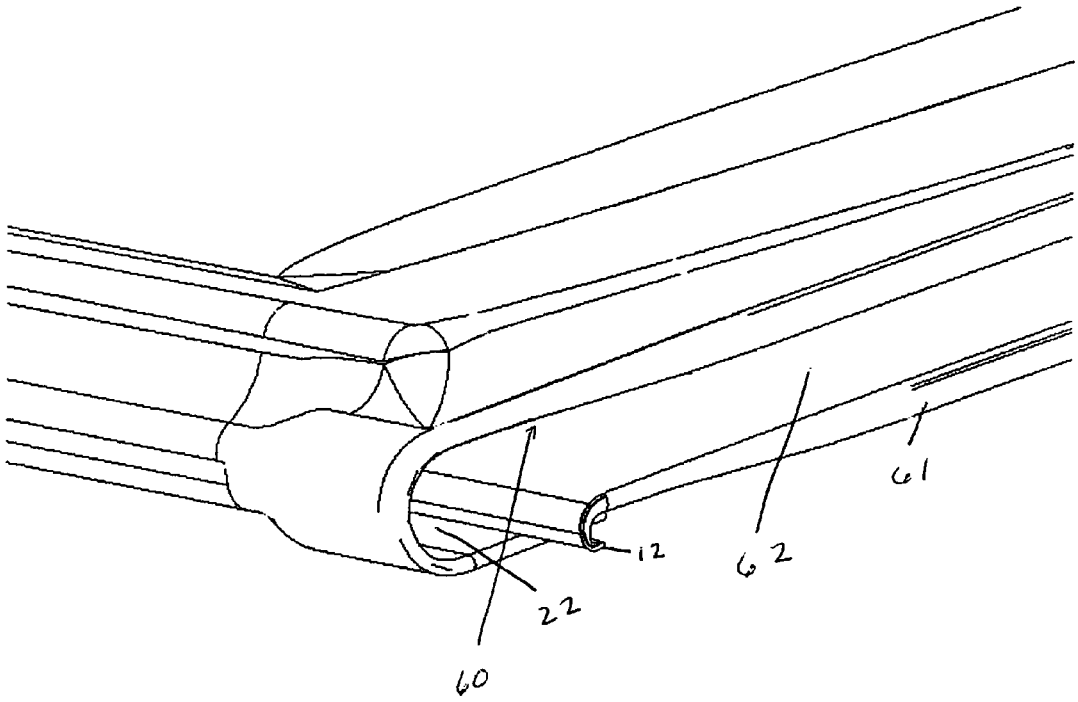
FIG. 9 is an exploded view of the lower right edge of the shingle in FIG. 1.

Referring to FIG. 4, metal shingle 10 has a left, or trailing, edge 13, which is not folded, except along the top edge 11 and bottom edge 12 as described above. The right, or leading, edge 14 is first turned up in the direction of the top surface 15 of the shingle. The right side is then bent to form an S fold 60 approximately 1.5 inches from the edge. This S fold 60 receives the left edge of the adjacent shingle. FIG. 4 shows S fold 60 and upturned fold 61 at right edge 14. The area between S fold 60 and upturned fold 61 creates a gutter 62 into which water that has leaked between adjacent shingles is captured. This S fold is created along the entire edge (length) of shingle 10, including the areas where top edge 11 is folded over and bottom edge 12 is folded under. Thus, gutter 62 extends the entire length of the shingle. At the top edge 11, the gutter 62 combines with overturn C shape 21, as shown in FIG. 8. At the bottom edge 12, the gutter combines with underturned C shape 22, as shown in FIG. 9. Since the bottom edge 12 is underturned, water that has accumulated in the gutter 62 is able to spill onto the top surface 15 of the shingle in the lower row.

FIG. 8 is an exploded view of the upper right corner of shingle 10. As described earlier, an S shaped fold 60 is created at a location spaced from the right edge. The right edge of the metal shingle is then folded to form upturned fold 61. The space between the S fold on one side and the upturned right edge on the other side defines the gutter 62. As a result, the particular spacing of the S shaped fold defines the width of gutter 62. A unique feature of this roofing shingle is that both S fold 60 and upturned edge 61 are also incorporated in the bending operation that creates C shape 21 along top edge 11. To create this shingle, the blank travels through a multi-station tooling die that performs the folding in a series of sequential operations. In each of the stations there is one or more folds being accomplished and in most instances work is being done to both the vertical and horizontal edges. The folding operation comprises a number of stations to complete the edges.

In many previous metal shingles, this gutter extended only to the point at which the C shape fold begins. With such conventional shingles, in severe weather conditions, water that is collected in the gutter can be blown upward. Therefore, since the C shape bend does not exist in traditional shingles, there is nothing to block this upward movement of the water. Thus, it simply drips off the top edge of the gutter and therefore contacts the roofing surface, resulting in potential leaks.

FIG. 9 is an exploded view of the lower right corner of shingle 10. Gutter 62 is formed between S fold 60 and upturned edge 61. Near the bottom of the metal shingle, the right edge meets the C shape 22 formed at the bottom edge 12. As in the case of the upper right corner, the gutter is also formed into the same underturned C shape 22 as the rest of the bottom edge. Using this configuration, any water that is captured in the gutter 62 will be directed onto the top surface of the shingle in the adjacent lower row. This prevents leakage, as the water always remains on top of the shingles.

Figure 10:
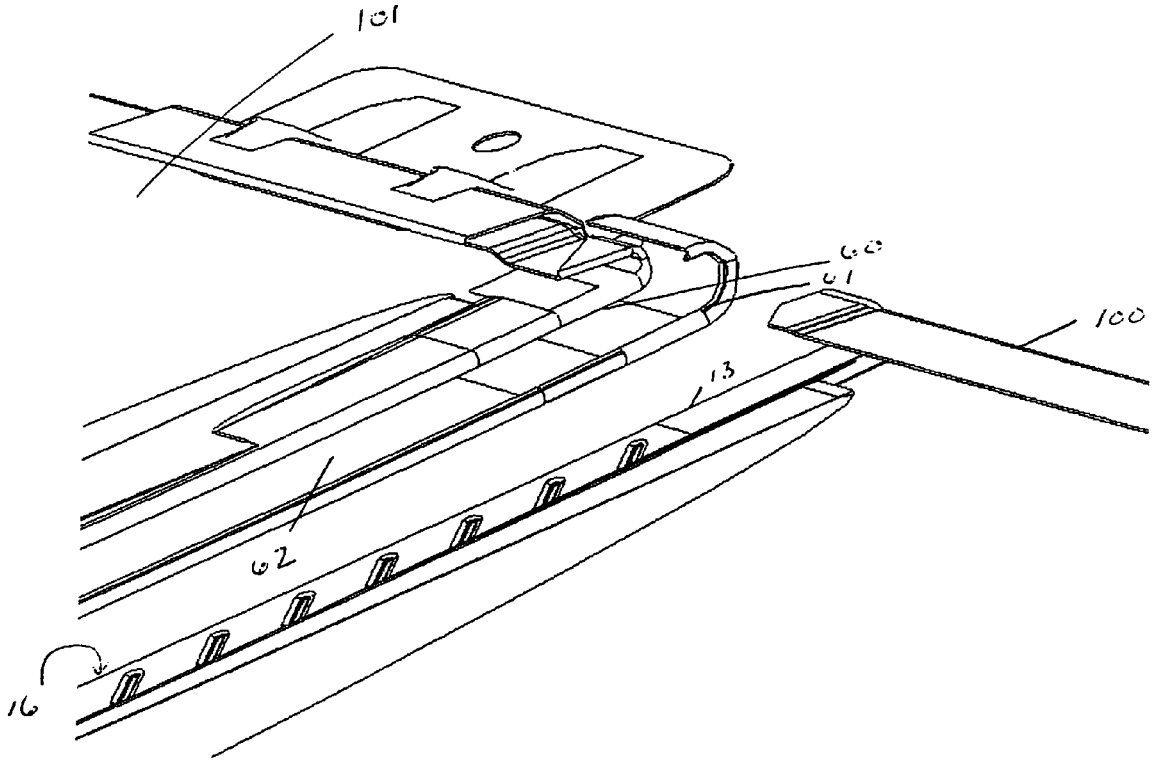
FIG. 10 is a side view showing the interconnection of two adjacent shingles in the same row.

FIG. 10 illustrates the connection between two adjacent shingles in a row when installed on a roofing surface. The left edge 13 of right shingle 100 is inserted into the S fold 60. The upturned right end 61 of left shingle 101 creates a barrier which prevents water from escape from the gutter 62. Typically, upturned right end 61 contacts the bottom surface 16 of right shingle 100, providing a further barrier to leakage between the mated shingles.

A second shortcoming to the metal shingle systems currently available is maintaining the aesthetic appearance of the roofing materials along the edge of the roof and around roof penetrations when the metal is terminated (cut), exposing an undesirable cut edge. This exposed cut must be hemmed or concealed to prevent rust from forming along the cut edge. Simply hemming the edge back on itself is not aesthetically accepted in residential roofing. Metal shingles are typically designed in such a way that the lower portion of the shingle is formed to sit above the roofing surface, while the upper portions rests directly on the roofing surface, as shown in FIG. 3. In this figure, the top surface of the shingle near C shape 21 rests directly on the roofing surface, while the top surface of the shingle near C shape 22 is elevated above the roofing surface. This gives the appearance of cascaded cedar shingles, where each rests on the one below it. A specific shortcoming with this implementation is the shape of the shingle near the edges, specifically when the shingle needs to be trimmed to fit into the desired space.

Traditional bending devices are made with long, flat edges. While preferable in most applications, it creates a misshaped, aesthetically displeasing edge on the shingle during installation. It is preferably that the shingle retains its asymmetric appearance, where it appears thicker toward the bottom edge than at the top edge. This is not possible using traditional flat edged bending devices.

Figure 11:
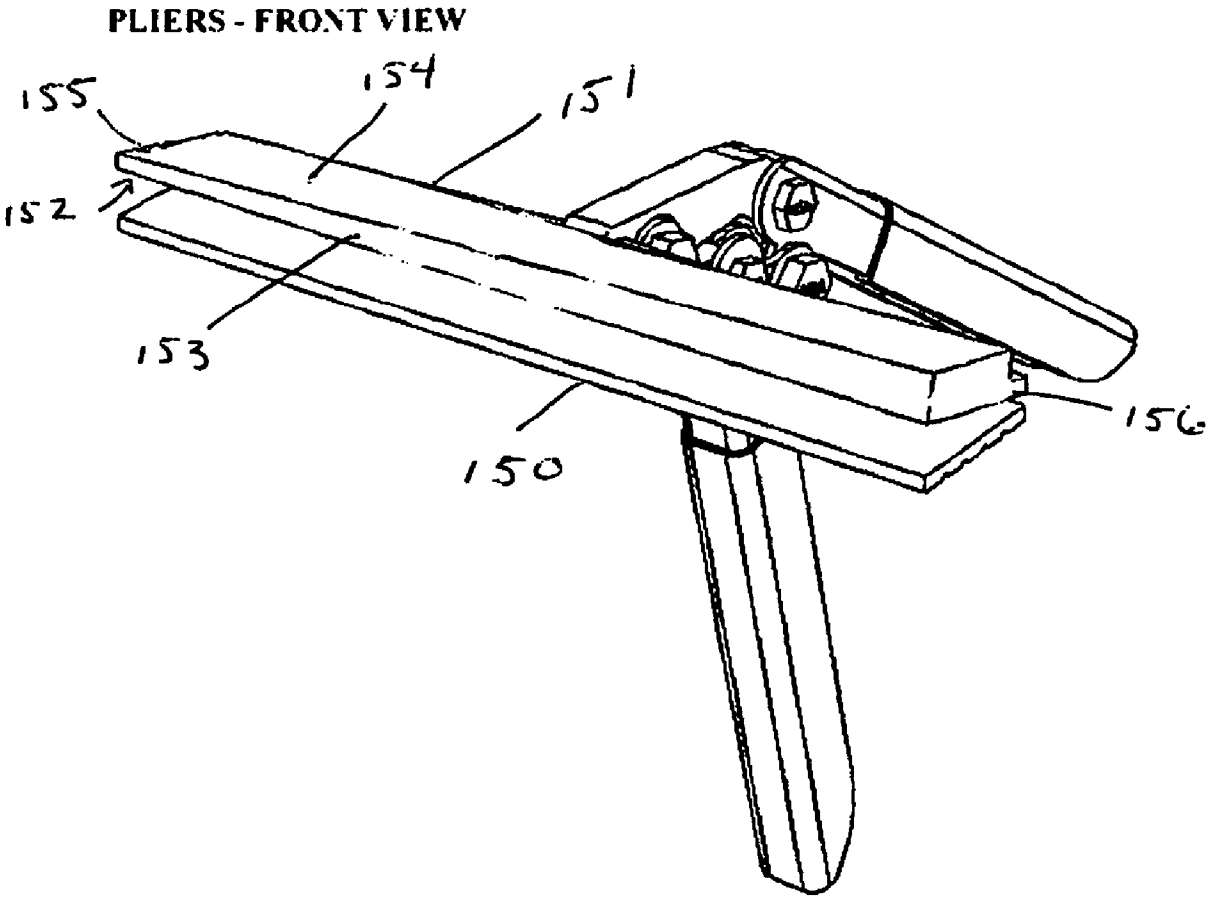
FIG. 11 is a perspective view of a first embodiment of the pliers used in the present invention to bend the shingle of FIG. 1.
Figure 13:
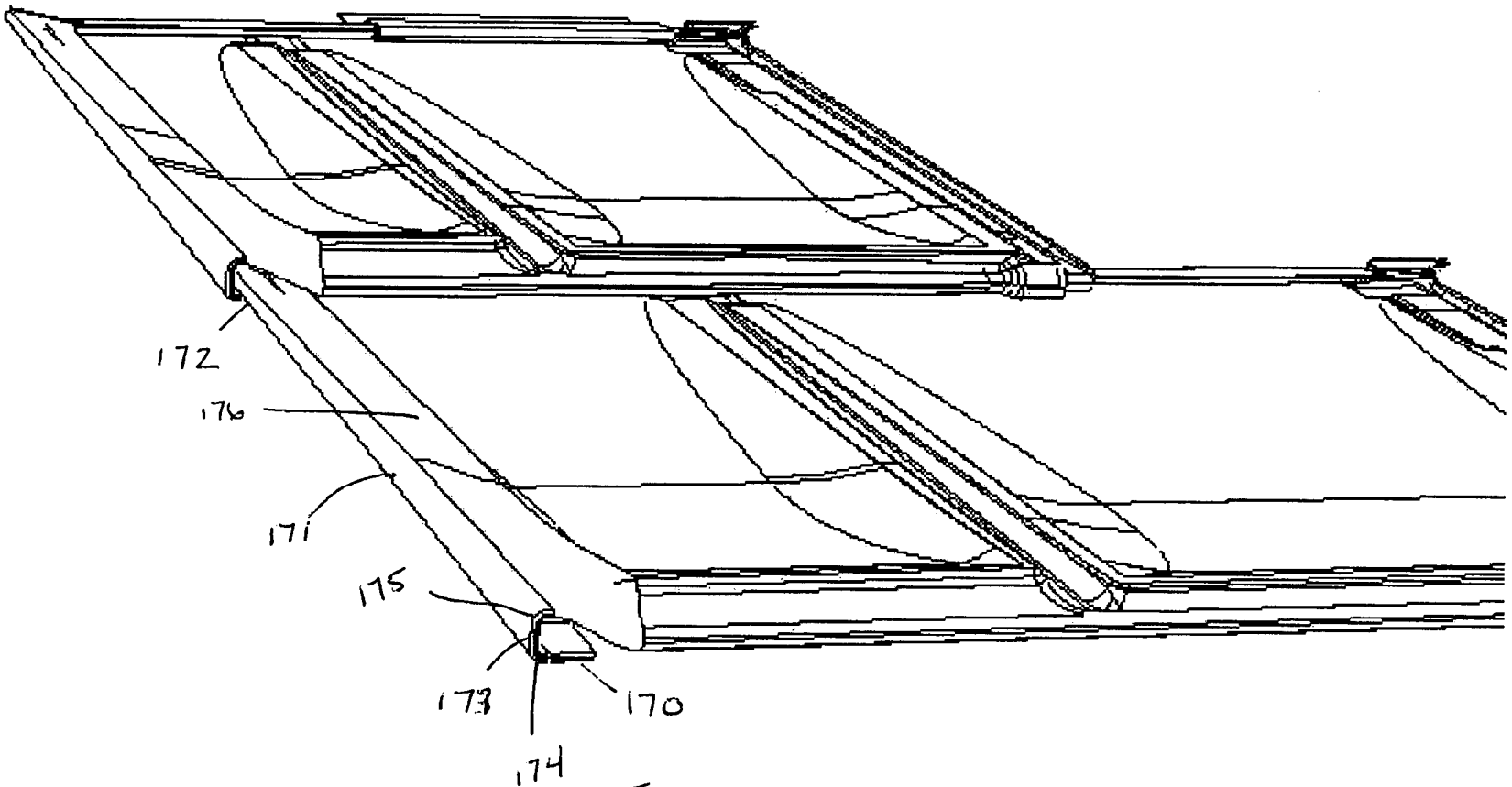
FIG. 13 is a perspective view of a shingle bent using the pliers of the present invention.

A solution to this shortcoming is the development of bending devices, such as the pliers shown in FIG. 11, that are designed to bend the shingle in such a way so as to retain the asymmetric appearance as shown in FIG. 13. Preferably, this is done by having the thickness of either the upper or lower jaw of the pliers increase linearly from one side to the other. In this way, the edge is gripped by the pliers, which then bend the metal into two angles. As an example, using the pliers of FIG. 11, the metal shingle is gripped between the jaws, with the top surface of the shingle in contact with the lower jaw 150. As shown in FIG. 13, this gripped portion becomes folded-under edge 170. As the pliers are rotated downwardly with respect to the top surface of the shingle, a first angle 174 is created between folded-under edge 170 and sidewall 171, which corresponds to the angle between the flat surface 152 and the front surface 153 of the upper jaw 151. As the pliers continue rotating, a second angle 175 is created between sidewall 171 and top surface 176, which corresponds to the angle between the front surface 153 and the top surface 154 of the upper jaw 151. Since the upper jaw is thicker at end 156 than at end 155, the shingle is bent such that it is thicker on that end than on the other. Thus, the sidewall 171 is thicker at end 173 than it is at end 172, thereby preserving the asymmetric appearance of the shingle. Knowing that the shingle was placed in the pliers with its top surface in contact with the lower jaw, this plier is properly configured to create the proper angle when used on the left side of the metal shingle.

In order to properly bend the right edge of a metal shingle, it is necessary that a tool be created in which the upper jaw is formed with the thicker side at 155 and the thinner side at 156. While possible, it presents a drawback to installers, who are now forced to carry two similar, but different, bending tools in order to properly install a metal shingle system.

Figure 12:
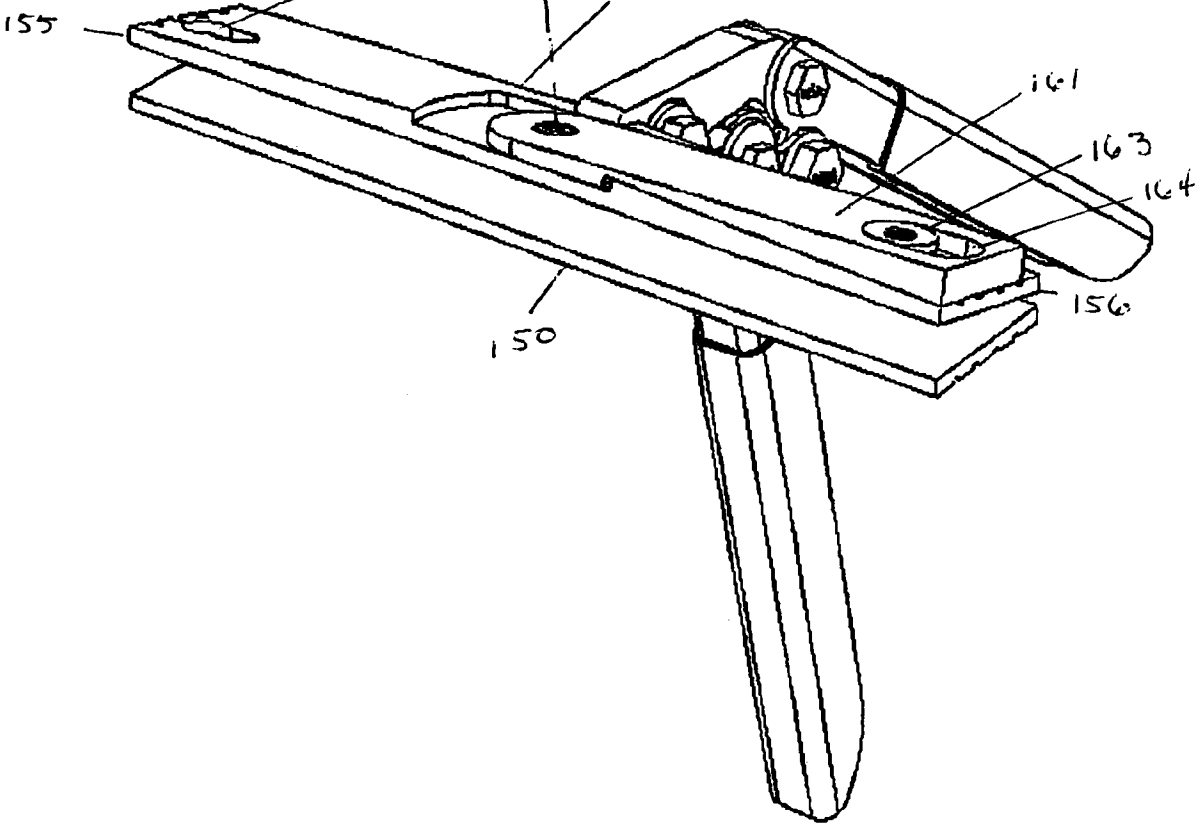
FIG. 12 is a perspective view of a second embodiment of the pliers used in the present invention to bend the shingle of FIG. 1.

FIG. 12 illustrates a second embodiment of these pliers. FIG. 12 shows a single set of pliers that can be used to create a suitable bend for both the left and right edges of a metal shingle. Lower jaw 150 of the pliers remains unchanged in this embodiment. However, upper jaw 160 is modified. The upper jaw 160 increases in thickness from end 155 toward the center. Similarly, it increases in thickness from end 156 toward the center. Rotationally affixed to the center of upper jaw 160 is rotating block 161. Rotating block 161 is designed to pivot about axis 162 such that it can positioned toward side 155 or on side 156. Structurally, its lower edge is sloped downward at the same angle as the portion of the upper jaw upon which it rests. Its upper edge is sloped upward at the same angle as the portion of the upper jaw which remains exposed. In this manner, the rotating block 161, in conjunction with the exposed portion of the upper jaw create a flat inclined surface. When the rotating block 161 is rotated to cover the previously exposed part of the upper jaw 160, it creates a second inclined flat surface. By rotating the block in this manner, the pliers can be readily adapted to bend either side of the metal shingle.

As previously described, rotating block 161 has two utilitarian positions. Preferably, a mechanism exists by which the rotating block 161 is held in place in each of these positions. One such mechanism is illustrated in FIG. 12. In this embodiment, rotating block 161 is held in place via a fastener 163, which extends through a hole 164 in the rotating block and a hole 165 in the upper jaw 160. Preferably, a keyhole-shaped hole is used such that the fastener can fit through the hole and then slidingly engage. While this is the preferred embodiment, others are possible without departing from the spirit of the invention.

What is claimed is:

1. A roofing shingle having a top surface and a bottom surface, comprising:

an upper edge folded over toward said top surface;

a lower edge folded under toward said bottom surface and adapted to engage said folded over top surface of a lower adjacent shingle;

a first unfolded side edge of the shingle;

a second side edge, folded toward said top surface to form one side wall of a gutter, said gutter comprising three walls and a sole egress;

an S shaped fold spaced apart from said folded side edge, forming a second side wall of said gutter and adapted to receive said first side edge from a lateral adjacent shingle, where said folded over upper edge forms a third wall of said gutter and said folded under bottom edge forms said sole egress for water collected in said gutter.

2. A roofing system comprising a plurality of shingles, wherein each shingle comprises:

an upper edge folded over toward said top surface;

a lower edge folded under toward said bottom surface and adapted to engage said folded over top surface of a lower adjacent shingle;

a first unfolded side edge of the shingle;

a second side edge, folded toward said top surface to form one side wall of a gutter, said gutter comprising three walls and a sole egress;

an S shaped fold spaced apart from said folded side edge, forming a second side wall of said gutter and adapted to receive said first side edge from a lateral adjacent shingle, where said folded over upper edge forms a third wall of said gutter and said folded under bottom edge forms said sole egress for water collected in said gutter.

3. A roofing shingle having a top surface and a bottom surface, comprising:

an upper edge folded over toward said top surface; a lower edge a side edge, folded toward said top surface to form one side wall of a gutter;

an S shaped fold spaced apart from said folded side edge, forming a second side wall of said gutter and adapted to receive a side edge from a lateral adjacent shingle, where said folded over upper edge forms a third wall of said gutter and a second side edge.

4. A roofing shingle having a top surface and a bottom surface, comprising:

a lower edge folded under toward said bottom surface; an upper edge a side edge, folded toward said top surface to form one side wall of a gutter, said gutter comprising three walls and a sole egress;

an S shaped fold spaced apart from said folded side edge, forming a second side wall of said gutter and adapted to receive said first side edge from a lateral adjacent shingle, where said folded under bottom edge forms said sole egress for water collected in said gutter; and a second side edge.

* * * * *